US005580644A

United States Patent [19]

Minami

[11] Patent Number: 5,580,644

[45] Date of Patent: Dec. 3, 1996

[54] THREE-DIMENSIONAL NON-WOVEN FABRIC AND METHOD OF PRODUCING THE SAME

[75] Inventor: Akinori Minami, Koga, Japan

[73] Assignee: Japan Vilene Company, Ltd., Tokyo, Japan

[21] Appl. No.: 275,386

[22] Filed: Jul. 15, 1994

[30] Foreign Application Priority Data

Sep. 27, 1993 [JP] Japan ..... 5-260437

[51] Int. Cl.[6] ..... D03D 3/00

[52] U.S. Cl. ..... 428/221; 156/73.2; 156/73.5; 156/253; 156/268; 156/269; 156/309.6; 210/150; 210/615; 428/224; 428/397; 428/400

[58] Field of Search ..... 428/224, 222, 428/373, 374, 397, 400, 358, 221; 156/73.2, 73.5, 253, 268, 269, 309.6; 210/615, 150

[56] References Cited

U.S. PATENT DOCUMENTS

| | | | |
|---|---|---|---|
| 4,789,577 | 12/1988 | Leone et al. | 428/222 |
| 5,173,352 | 12/1992 | Parker | 428/222 |
| 5,424,113 | 6/1995 | Ray et al. | 428/222 |

FOREIGN PATENT DOCUMENTS

| | | |
|---|---|---|
| 63-209787 | 8/1988 | Japan . |
| 1-229857 | 8/1989 | Japan . |
| 3-38299 | 2/1991 | Japan . |
| 3-27138 | 2/1991 | Japan . |

*Primary Examiner*—James J. Bell
*Attorney, Agent, or Firm*—Oliff & Berridge

[57] ABSTRACT

A three-dimensional non-woven fabric having at least one junction portion in the internal portion thereof may be obtained by forming, and maintaining a distance between, linear junction portions in a piece of starting non-woven fabric or in a laminate of a plurality of layers of starting non-woven fabric, followed by cutting the formed non-woven fabric at a position or along a line between one linear junction portion and another linear junction portion; or by forming dot-like junction portions in a piece of a starting non-woven fabric or in a laminate of a plurality of layers of a starting non-woven fabric, followed by cutting the formed non-woven fabric into a desired shape so as to include the dot-like junction portion. The three-dimensional non-woven fabric has a large strength, excellent shape stability, large surface area, thereby being advantageously utilizable as a carrier for fixing or immobilizing microorganisms or in various other applications.

35 Claims, 4 Drawing Sheets

THREE-DIMENSIONAL NON-WOVEN FABRIC AND METHOD OF PRODUCING THE SAME

BACKGROUND OF THE INVENTION

The present invention relates to non-woven fabrics having novel structures. An object of the present invention is to provide new materials by using non-woven fabrics. The fabrics with unique three-dimensional structures, wherein at least one junction portion is positioned in the internal portion thereof.

Microorganism-fixing carriers made of non-woven fabrics on which microorganisms are adhered and are allowed to propagate have heretofore been used for treating waste water and as a microorganism reactor for industrial uses, as disclosed in Unexamined Published Japanese Patent Application (Japan Kokai) Nos. 209787/1988, 229857/1989 and 38299/1991. The microorganism-fixing carriers made of non-woven fabrics have excellent capacity for carrying microorganisms since the non-woven fabrics have porous structures. However, they tend to be easily loaded due to the formation of a film of microorganisms that are propagated, and thus a limitation is imposed on the amount of microorganisms that can be carried. Furthermore, the contact area between the microorganisms and the liquid, such as waste water that is to be treated by the microorganisms, is small.

As a microorganism-fixing carrier, there has been proposed a cord-like contact material (Biocord™ manufactured by TBR Co., Japan) that employs braided cord technology. However, the cord-like contact material is manufactured through complex manufacturing steps with low productivity and at a high cost, without yielding large contact area. Moreover, this material has a defect in that it tends to be easily deformed.

In an attempt to increase the amount of microorganisms that can be carried and to increase the contact areas, the present inventors have studied the use of a cylindrical, three-dimensional, non-woven fabric that is obtained by flatly or spirally winding a non-woven fabric.

However, the cylindrical, three-dimensional, non-woven fabric obtained by winding a sheet-like non-woven fabric has a weak tensile strength, and is broken or is deformed when a strong tensile force is applied thereto during use of the fabric. Moreover, the fibers that are chiefly oriented in the circumferential direction lack resistance against compression. Besides, aerobic bacteria propagate only on the surface portion of the non-woven fabric. Even when the non-woven fabric is obtained in a three-dimensional form, therefore, the interior of the non-woven fabric is not sufficiently utilized, making it difficult to increase the amount of microorganisms that are carried thereon or to sufficiently increase the contact area with respect to the liquid to be treated.

There have further been proposed: (1) a spherical and solid non-woven fabric which is obtained by packaging a fiber in a spherical mold and fixing it by using an adhesive agent or with an adhesive fiber or by molding a bulky non-woven fabric or fiber webs under the application of heat and pressure, followed by cutting the mold into a sphere; and (2) a coupled bulky ball-like structure obtained by converging and fixing bundles of bulky fibrous yarns at a predetermined interval, as disclosed in Unexamined Published Japanese Patent Application (Japan Kokai) No. 27138/1991.

Like the aforementioned cylindrical three-dimensional non-woven fabrics, however, these three-dimensional non-woven fabrics lack tensile strength, and are subject to be broken or deformed when a strong tensile force is applied thereto during use. These fabrics also fail to exhibit a restoring property after being compressed, and impose limitations on the amount of carried microorganisms and on the contact areas.

Furthermore, a three-dimensional non-woven fabric has been desired even in other fields for such uses as, for example, laces, ornamental products made of fibers, and wadding. However, the cylindrical three-dimensional non-woven fabric obtained by winding the non-woven fabric or the spherical three-dimensional non-woven fabric obtained by packaging the non-woven fabric in the mold and fixing it by using an adhesive agent or an adhesive fiber, still has weak tensile strength and is subject to be broken or deformed when a strong tensile force is applied thereto during use. Such non-woven fabrics have continuous surfaces that only slightly absorb external force, give hard feeling to the touch, and are distorted upon bending. Moreover, the fibers that tend to be oriented in the circumferential direction exhibit small resistance against the compression and fail to restore the fabric to its initial shape after being compressed.

SUMMARY OF THE INVENTION

An object of the present invention is to provide a novel three-dimensional non-woven fabric material manufactured by the use of a non-woven fabric. Particularly, an object of present invention is to provide a three-dimensional non-woven fabric having excellent tensile strength, advantageous resistance against compression, and a significantly large surface area.

The present invention relates to a three-dimensional non-woven fabric having a junction portion in the internal portion thereof. Further, the present invention relates to three-dimensional non-woven fabric goods possessing at least one junction portion in the internal portion thereof.

The present invention thus relates to a three-dimensional non-woven fabric having one of various radial cross-sectional shapes and having a substantially linear or dot-like junction portion in the internal portion thereof.

The present invention thus relates to a three-dimensional non-woven fabric having a radial sectional shape that is continuous in the lengthwise direction. One embodiment of the present invention relates to a non-woven fabric obtained by forming, and maintaining a distance between, linear junction portions in a piece of starting non-woven fabric or in a laminate of a plurality of layers of starting non-woven fabric, followed by cutting the formed non-woven fabric at a position or along a line between one linear junction portion and another linear junction portion. Another embodiment of the present invention relates to a non-woven fabric obtained by forming dot-like junction portions in a piece of starting non-woven fabric or in a laminate of a plurality of layers of starting non-woven fabric, followed by cutting the formed non-woven fabric into a desired shape so as to include the dot-like junction portion. According to the present invention, a spherical three-dimensional non-woven fabric is obtained from a circular starting non-woven fabric and, furthermore, three-dimensional non-woven fabrics of a variety of shapes are obtained by changing the shape of the starting non-woven fabric.

DETAILED DESCRIPTION OF THE INVENTION

The invention will now be described in detail with reference to specific embodiments thereof.

The present invention provides a three-dimensional non-woven fabric having a radial cross-sectional shape and having a junction portion in the internal portion thereof. More particularly, the present invention provides a three-dimensional non-woven fabric with a cross-sectional shape wherein said shape is continuous in the lengthwise direction thereof. According to the present invention, furthermore, there is provided a method of manufacturing a three-dimensional non-woven fabric by forming, and maintaining a distance between, linear junction portions in a piece of starting non-woven fabric or in a laminate of a plurality of pieces of starting non-woven fabric, followed by cutting the formed non-woven fabric at a position or along a line between one linear junction portion and another linear junction portion.

Figure 1:
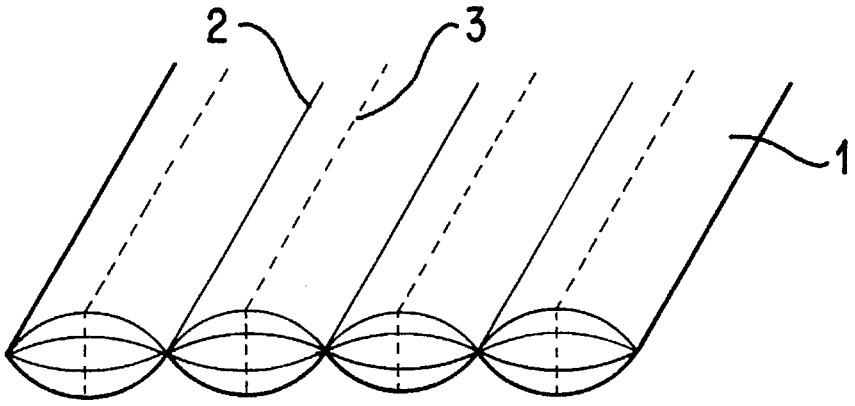
FIG. 1 is a diagram illustrating a three-dimensional non-woven fabric of the present invention in a step of production.
Figure 2:
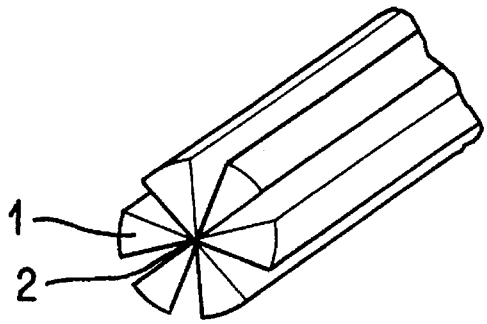
FIG. 2 is a partial perspective view illustrating the three-dimensional non-woven fabric having a cross-sectional shape of petals according to the present invention.
Figure 3:
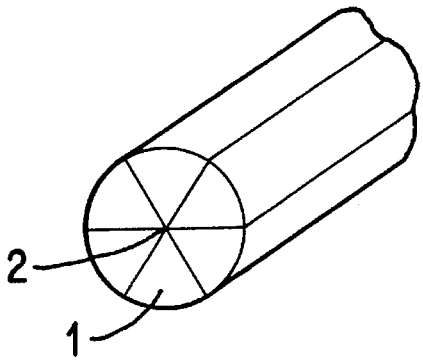
FIG. 3 is a partial perspective view illustrating the three-dimensional non-woven fabric in the shape of a cylinder according to the present invention.

According to the present invention as shown in FIG. 1, there is obtained a three-dimensional non-woven fabric having non-woven fabric pieces that are joined together at a junction portion and having a radial cross-sectional shape by forming, and maintaining a distance between, linear junction portions 2 in a piece of non-woven fabric 1 or in a laminate of a plurality of pieces of non-woven fabric 1 in order to form a linear strongly compressed portion in the non-woven fabric having a predetermined thickness, followed by cutting the formed non-woven fabric at a position or along a line between one linear junction portion and another junction portion so that the non-woven fabric recovers its thickness at the cut portion. When there exists a gap among the non-woven fabric pieces, the three-dimensional non-woven fabric acquires the shape of petals in cross section as shown in FIG. 2. When there is no gap, the three-dimensional non-woven fabric acquires the cylindrical shape as shown in FIG. 3.

The linear junction portions 2 may be straight lines, undulated lines, solid lines, broken lines or dotted lines which are spaced apart equally or unequally. The junction portions can be formed, for example, by such sealing means as heat sealing, ultrasonic sealing or high-frequency sealing; by adhesion means using an adhesive agent; or by sewing means using a sewing machine or the like. The width of the junction portion can be arbitrarily selected. When the sealing means or the adhesion means is employed, however, preferably the linear junction portion has a width of from 1 to 5 mm. When it is not allowed to use a thermoplastic fiber for constituting the non-woven fabric, there should be employed the adhesion means or the sewing means. When it is allowed to use a thermoplastic fiber, it is recommended to use the sealing means from the standpoint of forming a junction portion having large tensile strength.

When it is intended to produce a three-dimensional non-woven fabric of a shape of symmetrical petals in cross section or a cylindrical three-dimensional non-woven fabric having a symmetrical shape in cross-section, the non-woven fabric should be cut at the center line between the two linear junction portions. When it is intended to produce a three-dimensional non-woven fabric of an asymmetrical shape in cross section, the fabric should be cut at a position that is deviated toward either junction portion. The cutting line 3 should preferably be a straight line but may be an undulated line as required.

An embodiment of the manufacturing process according to the present invention will now be described below in more detail.

One or a plurality of non-woven fabrics containing a heat-melting fiber are laminated one upon another, so that the thickness (T, cm) of the laminate will become $2T \geqq 45/360 \times \pi W$ with respect to the slit width, the slit width being the distance from one cutting line through the junction portion to the second cutting line (W, cm). The thus set non-woven fabric is, maintaining a predetermined distance, linearly and continuously sealed (using heat, ultrasonic waves, or high-frequencies) or by sewing, followed by cutting the sealed or stitched non-woven fabric into a product with a width W. The non-woven fabric acquires the shape of petals in cross section when a relationship between th thickness of the laminate and the width of the slit is $2T < \pi W$. It acquires the shape of a lace (circular) when the relationship is $2T \geqq \pi W$. In this case, it is desired to seal a laminate of a starting non-woven fabric having a cushioning property and a starting non-woven fabric which is hard and broad.

The non-woven fabric including at least 20% or more, and preferably 35% or more, of a heat-melting fiber and/or a heat-melting resin at the sealing portions exhibits an increased strength. A wire may be inserted in the sealing portions in order to further increase the strength.

The three-dimensional non-woven fabric has the following relations among the cross-sectional shape, thickness of the laminate and the slit width:

(1) When the linear junction portion is positioned at the center of the slit width:

a. When $2T < \pi W$, a gap exists among the non-woven fabric pieces, and the non-woven fabric opens like petals. When $2T \geqq$ (from $\frac{1}{3}\pi W$ to $\frac{1}{4}\pi W$), the petals open uniformly; when $2T<$ (from $\frac{1}{3}\pi W$ to $\frac{1}{4}\pi W$), the petals have a tendency to open nonuniformly.

b. When $2T \geqq \pi W$, no gap exists among the non-woven fabric pieces, and the fiber layers on the outer peripheral surfaces become continuous to acquire the shape of a lace. When the thickness is further increased by compression during sealing, the lace may be realized even when $2T<\pi W$.

Figure 4:
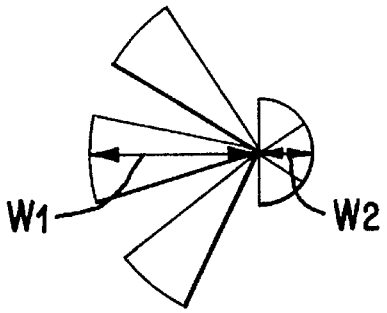
FIG. 4 is a cross-sectional view illustrating the three-dimensional non-woven fabric of the present invention in an embodiment where the distances from the junction portion to the cutting line are different between the right side and the left side.

(2) When the linear junction portion is positioned at a portion other than the center of the slit width: in the case where, as shown in FIG. 4, the distance from the cutting line to one junction portion is long (as denoted by W1) and the distance from the cutting line to another junction portion is short (as denoted by W2), the petals are obtained on the side of the longer non-woven fabric pieces when $T<\pi W1$ and the lace is obtained on the side of the shorter non-woven fabric pieces when $T \geqq \pi W2$.

The three-dimensional non-woven fabric having a linear junction portion in the internal portion thereof of the present invention has a structure in which non-woven fabric pieces are joined together at the linear junction portion as shown in FIGS. 2 and 3, and exhibits excellent tensile strength.

The three-dimensional non-woven fabric has a structure in which non-woven fabric pieces assemble together and the junction portion is at the internal linear portion only, exhibiting excellent shape stability yet offering a surface that is soft to the touch.

Moreover, even an external force that is exerted on the fabric is absorbed by the non-woven fabric pieces that have a freedom of movement, and only little distortion is left. Further, since the fibers are oriented along the non-woven fabric pieces, the fibers, as a result, are oriented from the internal junction portion toward the outside surface and exhibit excellent recovery against compression. Moreover, the three-dimensional non-woven fabric has a structure in which the non-woven fabric pieces assemble together and produce large surface areas. Therefore, for example, when the three-dimensional non-woven fabric is used as a microorganism-fixing carrier, it carries microorganisms in increased amounts, helps increase the chances of contact with the liquid to be treated, and enables the reaction by the microorganisms to be efficiently utilized.

Figure 6:
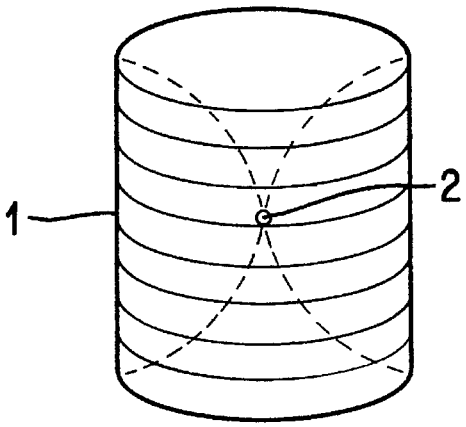
FIG. 6 is a diagram illustrating a three-dimensional non-woven fabric of the present invention in a step of production.

As shown in FIG. 6, furthermore, the three-dimensional non-woven fabric that is adhered at a dot-like junction portion may be obtained by forming a dot-like junction portion 2 in a piece of non-woven fabric 1 or in a laminate of a plurality of pieces of non-woven fabric 1 to form a dot-like strongly compressed portion in the non-woven fabric having a predetermined thickness, followed by permitting the non-woven fabric to recover the thickness in the portions other than the dot-like junction portion. The result is that a three-dimensional non-woven fabric is formed wherein non-woven fabric pieces assemble together at the junction portion.

The non-woven fabric to be laminated may have any shape including, but not limited to, a disk, an oval, a square, a polygon, a circle, a gourd, a dumbbell, a rectangle, a parallelogram, a rhombus, a triangle, quadrilateral, an oblong, and the like. All of the non-woven fabrics with various shapes can be put into practical use.

Figure 7:
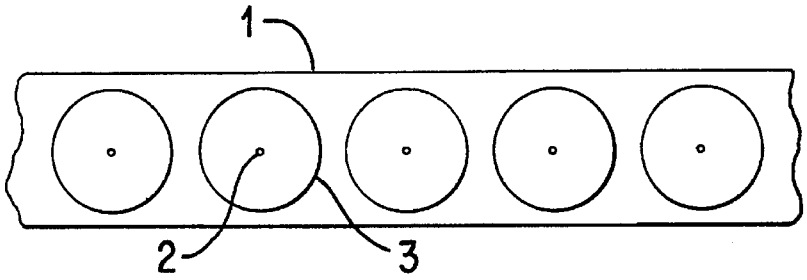
FIG. 7 is a diagram illustrating a step for producing the three-dimensional non-woven fabric of the present invention.

Referring to FIG. 7, the three-dimensional non-woven fabric of a spherical shape is obtained when the non-woven fabrics of a circular shape are laminated and are joined like a dot at the center of the circle.

In order to continuously manufacture the three-dimensional non-woven fabric, dot-like junction points 2 are formed, while maintaining a distance therebetween in a piece of long non-woven fabric 1 or in a laminate of a plurality of pieces of long non-woven fabric 1 as shown in FIG. 7, followed by cutting the non-woven fabric 1 into a product with a predetermined shape 3 (circular shape in FIG. 7) so as to include the dot-like junction portion 2. Strongly compressed dot-like junction portions are sequentially formed in the long non-woven fabric having a predetermined thickness, and the non-woven fabric is sequentially punched into any shape such as a circular shape, an oval shape, a square shape, a polygonal shape, a gourd shape, a dumbbell shape or the like so as to include the dot-like junction portion, permitting the non-woven fabric to recover its thickness at portions other than the dot-like junction portion. Such a process allows for the continuous production of three-dimensional non-woven fabrics such as the spherical non-woven fabrics as shown in FIG. 7, having non-woven fabrics pieces that are joined together at the dot-like junction portion.

Described next in more detail is an embodiment for producing a non-woven fabric that is joined like a dot.

First, a piece of non-woven fabric or a laminate of a plurality of pieces of non-woven fabric containing a heat-melting fiber is heat-sealed while being compressed and maintaining a predetermined distance between the junction portions to form dot-like junction portions. Then, the non-woven fabric is punched by using a circular punching mold with the dot-like junction portion as a center of the circular sections. The portions other than the dot-like junction portion recover the thickness of the non-woven fabric, so that the non-woven fabric acquires a spherical three-dimensional shape.

The laminated non-woven fabric may be punched entirely, or the upper layer, the lower layer, or both sides only of the laminate may be punched while leaving the central portion.

Figure 8:
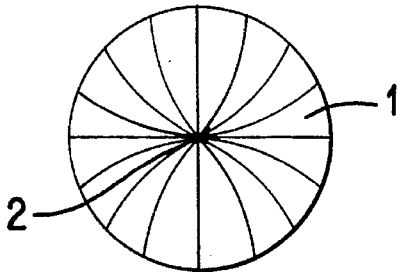
FIG. 8 is a cross-sectional view of a three-dimensional non-woven fabric of the present invention.

FIG. 8 illustrates in vertical cross section the structure of the spherical three-dimensional non-woven fabric in which non-woven fabric pieces are joined at the dot-like junction portion. The non-woven fabrics closer to the upper and lower surfaces prior to being joined together are greatly folded with the junction portion as a center. This spherical non-woven fabric has a structure in which non-woven fabric pieces assemble together and the junction portion is at the center of the sphere only. Therefore, the three-dimensional non-woven fabric gives soft touch-feeling and excellent shape stability. Moreover, even an external force that is exerted is absorbed since the non-woven fabric pieces have freedom of movement, and only little distortion remains. Moreover, since the fibers are oriented along the non-woven fabric pieces, the fibers tend to be oriented from the center of the sphere toward the outer surface, and exhibit excellent recovery against compression.

In the embodiment where the non-woven fabrics laminated first have a thickness T and a circle that is cut has a radius r, there exists no gap among the non-woven fabric pieces when $T \geqq \pi r$, and there exists a gap among the non-woven fabric pieces when $T<\pi r$.

Figure 9:
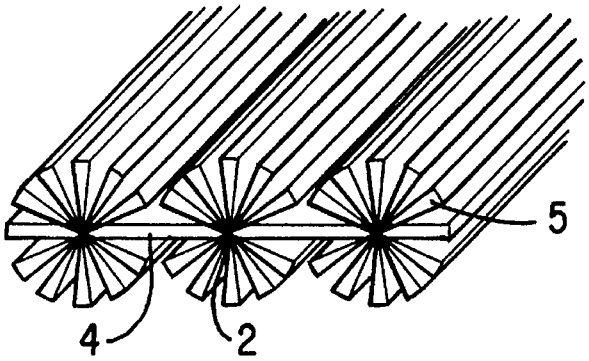
FIG. 9 is a perspective view of a three-dimensional non-woven fabric of the present invention.
Figure 10:
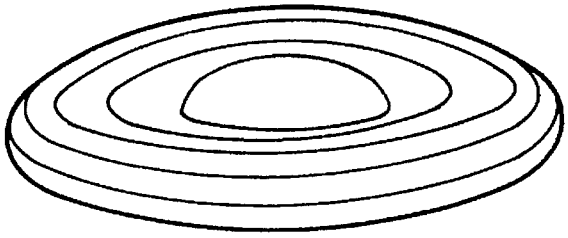
FIG. 10 is a perspective view of a three-dimensional non-woven fabric of the present invention.
Figure 11:
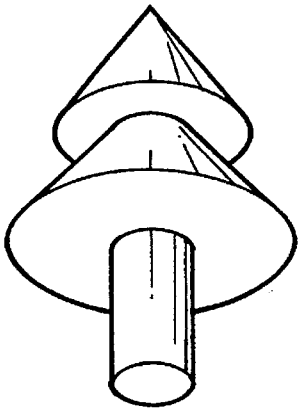
FIG. 11 is a perspective view of a three-dimensional non-woven fabric of the present invention.
Figure 12:
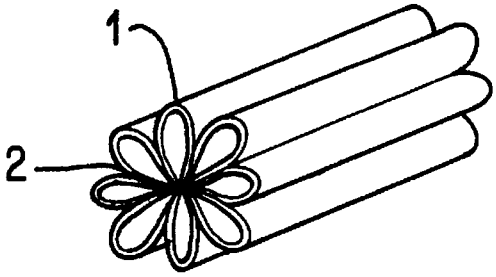
FIG. 12 is a perspective view of a three-dimensional non-woven fabric of the present invention.

According to the present invention, there can be further obtained (1) a three-dimensional non-woven fabric sheet (FIG. 9) having a linear junction portion and a plurality of non-woven fabric pieces fixed at the linear junction portion; (2) a ring-like three-dimensional non-woven fabric (FIG. 10) having a radial cross-sectional shape of radial and a ring-like linear junction portion in the internal portion thereof; (3) a three-dimensional non-woven fabric (FIG. 11) having a symmetrical cross-sectional shape with the linear junction portion as an axis and having a radial cross-sectional shape; and (4) a three-dimensional non-woven fabric (FIG. 12) having a linear junction portion in the internal portion thereof and a sectional shape in which a plurality of loop-like non-woven fabric pieces extend radially with the junction portion as a center.

The starting non-woven fabric may include, but is not limited to, natural fabrics, synthetic fabrics and semi-synthetic fabrics. The starting non-woven fabric preferably includes thermoplastic fibers. The synthetic and semi-synthetic fabrics may contain synthetic organic or inorganic fibers. Preferably the non-woven fabric is selected from the group consisting of a fiber manufactured from cotton, a polyolefin such as polyethylene or polypropylene; a polyamide; an acrylate or methacrylate; a polyester such as polyethylene terephthalate or polybutylene terephthalate; a polyvinyl chloride or a polyvinylidene chloride; a styrene copolymer; a vinylpyridine copolymer; a composite fiber such as a polyethylene/polypropylene composite fiber or a polyethylene terephthalate/polybutylene terephthalate core-sheath composite fiber; and the like.

When the non-woven fabric includes adhesive components such as thermoplastic fibers, the junction method may be such sealing means as ultrasonic sealing, high-frequency sealing or heat sealing, and the sealing may be effected discretely when the non-woven fabric is to be linearly joined.

When linearly joined, the sealing width can be any width but is preferably from about 1 to about 5 mm. When a large strength is required, the width of sealing should be large. To reinforce the strength, a cord, a mesh or a knitted material may be inserted in the sealing portion or on the whole surface, if desired.

When a thermoplastic fiber is used as the adhesive component in the non-woven fabric, it is desired that the non-woven fabric is chiefly constituted by a polyolefin, a polyester, a polyamide, a polyvinylidene chloride or an acrylic fiber.

A vinylon or a polyvinyl alcohol fiber can be sealed by the application of heated steam and pressure. The sealing may be either in the vertical direction or in the lateral direction.

The content ratio of the thermoplastic fiber varies depending upon the required tensile strength, flexibility, width and thickness of the sealing portion, and the kind of fiber that participates in the adhesion in the laminated non-woven fabric. It is, however, desired that the ratio of the fiber that participates in the adhesion in the non-woven fabric is at least 20% by weight or larger and, preferably, 40% by weight or larger.

The sealing may be accomplished even when the ratio of the thermoplastic fiber is smaller than 20% by weight. However, such sealing does not satisfy the requirements of a large tensile strength and shape retaining property. However, this problem can be solved when the non-woven fabric is sealed using a hot-melt adhesive or when a cord or a knitted mesh is inserted as a reinforcing material.

Moreover, the linear junction portion can be formed relying upon the adhesion means using an adhesive agent. In this case, the adhesive agent is applied, and the base material is adhered while being compressed.

The adhesive agent for use in the present invention may include those that are capable of strongly bonding the materials together or those that are capable of coupling two faces together by a chemical force, by a physical force, or by a combination thereof. Examples of the adhesive agent are preferably semi-synthetic high molecular weight adhesive agents and synthetic high molecular weight adhesive agents including an unsaturated aliphatic homopolymer or copolymer such as polyethylene, ethylene copolymer, polypropylene or propylene copolymer, polyvinyl chloride, polyvinylidene chloride, copolymerizable polyamide, copolymerizable polyester, vinyl acetate copolymer, acrylic resin, polyurethane, epoxy resin, cellulose derivative, or the like. The adhesive agent may be of the composite-type.

The materials obtained according to the present invention may be used for any of the applications where their properties can be utilized. For instance, the materials can be used as a carrier for holding or immobilizing microorganisms, animal cells and plant cells; as a material for polishing, brushing or cleaning; as a filter for gases, liquids, gas-solid mixtures, liquid-solid mixtures and the like; for those applications where water-absorbing property and oil-absorbing property are needed; for insulating or for maintaining temperature; for applications where shock-buffering property or cushioning property is required; for applications where advantageous visuality is required; and for applications where abrasion resistance is required; etc.

Examples of the carrier include a microorganism-fixing (immobilizing) carrier for purifying or cleaning water, a microorganism-fixing carrier for bioreactors, a microorganism-fixing carrier for culture, artificial seaweeds, man-made gathering-place for fish and artificial culture soil.

Examples of the three-dimensional non-woven fabric used for polishing, brushing and cleaning include a scrubbing brush, a sponge, a brush for washing cars, and a household brush.

Examples of the filter include a filter for trapping dirt and dust, a liquid filter, an air conditioner filter, and a filter of a vacuum cleaner.

Examples of the draining material include water conduit, draining material for civil engineering and the like.

Examples of the water-absorbing material include a water-absorbing pad, a dew-preventing material, a pad for medical applications, sanitary napkin, and athletic articles. Examples of the oil-absorbing material include an oil catcher, an oil fence and an oil-absorbing material.

Examples of the heat insulating material include an arctic muffler, a substitute for rope wound on trees, heat insulator for vehicles, and bedding are related products including clothes such as pajamas.

Examples of the sound-absorbing material include a sound-absorbing material for ducts, and sound-absorbing material for ships, automobiles and the like.

Examples of the shock-buffering material include corners, protectors and the like. Examples of the cushioning material include wadding, cushion, pillow, back pad, shoulder pad, etc. The non-woven fabric can be further used as ornamental products and toys such as dolls, stuffed toys, lace, cushioned building blocks, etc.

Further described below are the applications, properties and shapes of the material. When used as the microorganism-fixing (immobilizing) carrier for purifying or cleaning water in order to decrease BOD, COD, nitrogen, phosphorus and the like in rivers, lakes, ponds, sea and other places, the three-dimensional non-woven fabric has preferably a cross-sectional shape of petals or a radially opened shape in cross-section. These shapes help increase the surface areas of the carrier per a unit volume and increase the chances of contact with microorganisms, dissolved oxygen, nutrient sources and the like in the water. An increase in the surface area of the carrier permits aerobic bacteria and microorganisms present in the water to adhere thereto to form a film of microorganisms and helps increase the chances of contact between the film of microorganisms and matter dissolved in the water such as oxygen, organic substances and nitrogen compounds. As a result, due to the metabolism of aerobic bacteria in the presence of oxygen, the organic substances and nitrogen compounds contained in the water turn into microorganism body components, carbonic acid gas and water, so that the water is purified. Usually, microorganisms contained in the water of rivers or in the waste water to be treated spontaneously adhere to the microorganism-fixing (immobilizing) carrier and propagate thereon. It is, however, also allowable to artificially adhere microorganisms having particular functions in advance so that they will propagate.

When the cross-sectional diameter of the three-dimensional non-woven fabric used for the microorganism-fixing carrier is too small, sufficient contact area is not obtained. When the cross-sectional diameter of the three-dimensional non-woven fabric is too large, the water does not sufficiently permeate up to the central portions. Therefore, the cross-sectional diameter of the three-dimensional non-woven fabric is preferably from about 2 to about 15 cm, and more preferably from about 3 to about 12 cm. The fiber composition used for the non-woven fabric is preferably selected from the group consisting of a thermoplastic fiber manufactured from a polyolefin such as a polyethylene or a polypropylene, a polyester, a polyamide, a polyvinyl chloride or a polyvinylidene chloride. Such fibers may be used alone or in combination of two or more kinds. In order to impart hydrophilic property and carbon source, the three-dimensional non-woven fabric may contain non-thermoplastic fibers such as a viscose rayon, cotton and the like. When the fineness of the fiber is too small, the non-woven fabric tends to be easily loaded by the propagation of microorganisms; and when the fineness is too large, the microorganisms tend to adhere less. It is therefore desired that the fiber has the fineness of from about 5 to about 1000 denier, and more preferably from about 10 to about 100 denier.

When the non-woven fabric used for the three-dimensional non-woven fabric has a too great apparent density prior to forming the junction portion, the three-dimensional non-woven fabric tends to be easily loaded. When the apparent density is too small, however, the three-dimensional non-woven fabric loses shape stability. It is therefore desired that the non-woven fabric has an apparent density within a range of from about 0.01 to about 0.2 g/cm$^3$, and preferably within a range of from about 0.02 to about 0.1 g/cm$^3$.

The non-woven fabric may be the one obtained by being adhered with a fiber, the one obtained by being adhered with a binder, or the one obtained by mechanical entanglement. There is no particular limitation in the method of production. From the standpoint of strength and the like, however, it is desired to use the non-woven fabric obtained by being adhered with the fiber or the non-woven fabric obtained by being adhered with the binder. Furthermore, the non-woven fabric may be adhered with a polymer having a microorganism-adsorbing function or may be imparted with an ion-exchanging ability in order to increase the amount for fixing microorganisms and to quicken the adhesion of microorganisms. When the three-dimensional non-woven fabric is used as the microorganism-fixing carrier, the number of layers of the non-woven fabric to be laminated is preferably from about 3 to about 6 (the number of non-woven fabric pieces is preferably from about 6 to about 12), and each piece of non-woven fabric has preferably a thickness of from about 3 to about 15 mm.

Figure 5:
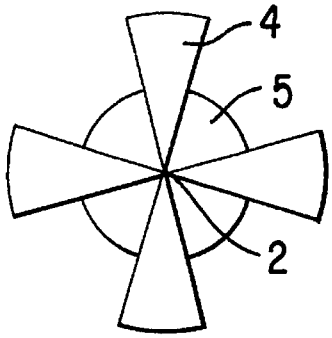
FIG. 5 is a cross-sectional view of the three-dimensional non-woven fabric of the present invention when it is obtained by laminating starting non-woven fabrics having different widths.

When it is desired to decrease the thickness of each non-woven fabric piece, to decrease the number of non-woven fabric pieces and to evenly open the non-woven fabric pieces, it is recommended to alternatingly laminate a thin, dense and wide non-woven fabric 4 and a thick, elastic and narrow non-woven fabric 5, followed by linearly sealing the central portions thereof as shown in FIG. 5. The three-dimensional non-woven fabric of such a shape is particularly effective when it is desired to carry out the water treatment using aerobic bacteria together with anaerobic bacteria. A film of aerobic bacteria has a tendency to be easily formed on the peripheral open portions and a film of anaerobic bacteria has a tendency to be easily formed on the central packaged portions. Using the three-dimensional non-woven fabric of the present invention, it is possible to control the gap among the non-woven fabric pieces. It is therefore possible to provide a three-dimensional non-woven fabric having either an increased region or a decreased region for forming the film of aerobic bacteria depending upon the purifying conditions.

When used as a scrubbing brush or a polishing material, the three-dimensional non-woven fabric must have cushioning property (repellent elasticity) and abrasion resistance (particularly on the slit section). For this purpose, the non-woven fabric should be one in which the ends of the fibers are exposed to the surfaces. The shape should be such that the gap is small among the petals or that the petals abut with each other forming a lace. Moreover, the slits may be meandered to realize a rugged cord-like shape similar to that of a gourd. The fiber composition preferably consists of a polyamide, a polyester, a polyolefin, a vinyl chloride or the like and the ingredients of the composition are preferably each selected from material having high rigidity. In order to increase the abrasion resistance, the non-woven fabric is preferably adhered by using an adhesive agent in addition to being adhered with the heat-melting fiber. The amount of the adhesive agent (inclusive of adhesive fiber) is preferably about 30% or larger, and the fineness is preferably from about 0.1 denier to about 100 denier, though it may vary depending upon whether the non-woven fabric is used for coarse polishing or finishing. Moreover, a polishing agent (e.g., carborundum, etc.) may be applied thereto.

Touch feeling plays an important role when the three-dimensional non-woven fabric is used for laces such as Christmas decoration, clothing (in which sealing portion should be sewed, i.e., compressed and sewed by a sewing machine), mufflers, and accessories. In this case, there should be no gap among the non-woven fabric pieces. The fiber composition may be preferably a polyamide, a polyester, an acrylic fiber, a polyolefin, a rayon, cotton, mixtures thereof and the like. The non-woven fabric preferably has a fine structure as from about 0.1 to about 12 denier and should exhibit voluminous feeling, soft touch-feeling and heat-insulating property by using a highly crimped fiber and a latently crimped fiber in combination.

The present invention makes it possible to easily obtain long three-dimensional non-woven fabrics having a large tensile strength and having a shape of petals or a radial shape in cross-section, or three-dimensional non-woven fabrics of a ball-like shape or the like having excellent touch-feeling and recovery property against compression, and maintaining of fluffs in the fabric.

There is thus provided a material that can be used in a variety of applications. In particular, the three-dimensional non-woven fabric of the present invention has a large strength, excellent shape stability, and large surface area, thereby being utilizable as a carrier for fixing or immobilizing microorganisms.

The following examples are intended to illustrate the invention in further detail and should by no means be construed as limiting the scope of the present invention.

EXAMPLE 1

Five pieces of a heat-bonding non-woven fabric comprising a polyethylene/polypropylene composite fiber (ES fiber, fineness of 20 denier, produced by Chisso Co., Japan) each having a weight of 200 g/m$^2$, a thickness of 8 mm and an apparent density of 0.025 g/cm$^3$, are laminated, and linear sealing portions extending in the lengthwise direction are formed by an ultrasonic sealing method maintaining a distance of 8 cm in the direction of width. Both sides of the sealing portion are then slit in the lengthwise direction maintaining a width of 4 cm on both sides at the sealing portion.

There is thus formed a three-dimensional non-woven fabric of a diameter of about 8 cm having 10 pieces of petals in cross-section, the inner peripheral portion being intimately contacted and the outer circumferential portion being opened.

The cord-like three-dimensional non-woven fabric is cut to a length of one meter and is used as a microorganism-fixing carrier for treating the water such as of ponds, lakes, swamps, rivers, sea and the waste water from the factories. Because of its large tensile strength and excellent recovering property against compression, the three-dimensional non-woven fabric is very resistant to being broken or deformed. The three-dimensional non-woven fabric has the shape of petals in cross-section and a large surface area, and carries microorganisms in large amounts and possesses large contact area with respect to the water.

EXAMPLE 2

A halogenated benzyl-4-vinylpyridine styrene copolymer for adsorbing microorganisms is adhered onto the base of the three-dimensional non-woven fabric of Example 1 to prepare a non-woven fabric. Five pieces of the thus obtained non-woven fabric are laminated in the same manner as in Example 1. The laminate is then sealed and slit to obtain a three-dimensional non-woven fabric that exhibits excellent ability for adsorbing microorganisms and is effectively used as a microorganism-fixing carrier.

EXAMPLE 3

An acrylic adhesive agent is applied to a web of a polyamide fiber having a fineness of 30 denier to prepare a non-woven fabric having a fiber/binder ratio of 60/40, a weight of 350 g/m$^2$ and a thickness of 15 mm. Eight pieces of this non-woven fabric are laminated, and are linearly sealed in the lengthwise direction by using a high-frequency welder. The laminate is then slit, maintaining a width of 5 cm with the sealed portion as a center. The laminated non-woven fabric expands like a circle in cross-section. That is, there is obtained a three-dimensional non-woven fabric without gaps among the non-woven fabric pieces and having high elasticity.

The non-woven fabric is cut into a length of one meter and is used as a substitute for a sponge for washing the body, or is wrapped around the hand to be used as a brush for washing a bath tub.

EXAMPLE 4

A non-woven fabric is prepared by using a core-sheath composite fiber having a fineness of 6 denier, and having a highly crimped core component of polyethylene terephthalate and a sheath component of polybutylene terephthalate, the non-woven fabric having a weight of 300 g/m$^2$ and a thickness of 25 mm. Four pieces of the thus obtained non-woven fabric are laminated, compressed, and are sewed at ten places in the lengthwise direction using a sewing machine, maintaining a distance of 6 cm. The laminate is then vertically slit at portions midway among the sewed lines. There are simultaneously obtained 10 long non-woven fabrics of the form of a lace having a diameter of about 6 cm in cross-section. This three-dimensional non-woven fabric offers soft touch-feeling, gives a high cushioning property, and is effectively used for Christmas decorations, cushioning material for clothing and winter laces.

EXAMPLE 5

Five pieces of a heat-bonding non-woven fabric composed of a polyethylene/polypropylene composite fiber (ES fiber, fineness of 20 denier, produced by Chisso Co., Japan) each having a weight of 200 g/m$^2$, a thickness of 8 mm and an apparent density of 0.025 g/cm$^3$, are laminated, and are sealed with ultrasonic waves like dots in the lengthwise direction maintaining a distance of 3 cm. The laminate is then punched into a circle of a radius of 1.5 cm with the dot-like sealed portion as a center to obtain a spherical three-dimensional non-woven fabric.

When used as a microorganism-fixing carrier for treating the water such as from ponds, lakes, swamps, rivers, sea and waste water from the factories, the spherical non-woven fabric is only slightly subject to deformation. The non-woven fabric has a radial cross-sectional shape and a large surface area, carries microorganisms in large amounts and possesses a large contact area with respect to the water.

EXAMPLE 6

A halogenated benzyl-4-vinylpyridine styrene copolymer for adsorbing microorganisms is adhered onto the base of non-woven fabric of Example 5 to prepare a non-woven fabric. Then, a spherical three-dimensional non-woven fabric is prepared in the same manner as in Example 5. The spherical three-dimensional non-woven fabric exhibits excellent ability for adsorbing microorganisms and is effectively used as a microorganism-fixing carrier.

EXAMPLE 7

An acrylic adhesive agent is applied to a web of a polyamide fiber having a fineness of 30 denier to prepare a non-woven fabric having a fiber/binder ratio of 60/40, a weight of 350 g/m$^2$ and a thickness of 15 mm. Ten pieces of this non-woven fabric are laminated, and are sealed like dots in the lengthwise direction maintaining a distance of 8 cm using an ultrasonic welder. The laminate is then punched in an oval shape having a long diameter of 8 cm and a short diameter of 6 cm so that the dot-like sealed portion is at the center, thereby to obtain a three-dimensional non-woven fabric without gaps among the non-woven fabric pieces and having high elasticity.

The non-woven fabric can be used as a substitute for a sponge for washing the body, or is wrapped around the hand to be used as a brush for washing a bath tub.

EXAMPLE 8

A non-woven fabric is prepared by using a core-sheath composite fiber having a fineness of 6 denier, and having a highly crimped core component of polyethylene terephthalate and a sheath component of polybutylene terephthalate, the non-woven fabric having a weight of 300 g/m$^2$ and a thickness of 25 mm. The non-woven fabric is cut into a circle of a radius of 3 cm. Five pieces of the thus obtained circles are laminated, compressed, and are joined at the center of the circle like a dot using a sewing machine. There is obtained a spherical non-woven fabric having a diameter of about 6 cm in cross-section. This three-dimensional non-woven fabric offers soft touch-feeling, provides a high cushioning property, and is effectively used for Christmas decorations, as cushioning material for clothing and the like.

EXAMPLE 9

A halogenated benzyl-4-vinylpyridine styrene copolymer is adhered as a polymer for adsorbing microorganisms onto a heat-bonding non-woven fabric of 50% by weight of a polyester fiber having a fineness of 15 denier and 50% by weight of a polyester/low-melting polyester composite fiber having a fineness of 15 denier, which has a weight of 250 $g/m^2$ and a thickness of 8 mm. The halogenated benzyl-4-vinylpyridine styrene copolymer is adhered in an amount of 0.5% by weight with respect to the non-woven fabric. Three pieces of the thus obtained non-woven fabric are laminated and are linearly sealed in the lengthwise direction by the ultrasonic sealing method (sealing width of 4 mm) and then, both sides of the sealed portion are slit in the lengthwise direction maintaining a width of 4 cm on both sides.

There is obtained a long three-dimensional non-woven fabric having a diameter of 8 cm forming six non-woven fabric pieces in cross-section with the joined portion as a center, the central portion being intimately contacted together and the outer peripheral portion maintaining gaps among the non-woven fabric pieces.

The three-dimensional non-woven fabric is cut into a length of one meter. The thus obtained three-dimensional non-woven fabrics are fixed into a frame of a metal or a plastic material such that the long side (one meter long) is in the up-and-down direction, maintaining a gap of 10 cm in the longitudinal and lateral directions, in order to constitute a purification unit measuring 0.6 m deep, 9 m wide and 1 m high.

River water having a BOD of 10 to 20 mg/liter is permitted to flow into the purification unit at a flow rate of one liter/second to measure a decrease in the BOD through a whole year. After having passed through the unit, the river water exhibits good quality having a BOD of 5 mg/liter or smaller.

What is claimed is:

1. A three-dimensional non-woven fabric comprising one or more pieces of non-woven fabric joined at least one junction portion in an internal portion of said three-dimensional non-woven fabric, said non-woven fabric having slits therein at positions other than at said at least one junction portion.

2. A three-dimensional non-woven fabric according to claim 1, wherein the at least one junction portion is substantially linear.

3. A three-dimensional non-woven fabric according to claim 2, wherein the three-dimensional non-woven fabric has a radial cross-sectional shape.

4. A three-dimensional non-woven fabric according to claim 3, wherein said shape is continuous in the lengthwise direction.

5. A three-dimensional non-woven fabric according to claim 2, wherein said three-dimensional non-woven fabric is in the form of a sheet.

6. A three-dimensional non-woven fabric according to claim 1, wherein said three-dimensional non-woven fabric is in the form of a ring having a radial cross-sectional shape and said at least one junction portion is a ring-like linear junction portion in the internal portion of said three-dimensional non-woven fabric.

7. A three-dimensional non-woven fabric according to claim 2, wherein the three-dimensional non-woven fabric has a cross-sectional shape symmetrical with the substantially linear junction portion as an axis and has a radial cross-sectional shape in a cross-sectional plane orthogonal thereto.

8. A three-dimensional non-woven fabric according to claim 2, wherein said three-dimensional non-woven fabric has a cross-sectional shape of a plurality of loop-like non-woven fabric pieces that radially extend in cross-section.

9. A three-dimensional non-woven fabric according to claim 4, wherein the three-dimensional non-woven fabric is substantially of a form of petals extending from said at least one junction portion.

10. A three-dimensional non-woven fabric according to claim 5, wherein the three-dimensional non-woven fabric is substantially of a form having a linear junction portion and a plurality of non-woven fabric pieces fixed at said linear junction portion.

11. A three-dimensional non-woven fabric according to claim 1, wherein the at least one junction portion is substantially a dot.

12. A three-dimensional non-woven fabric according to claim 11, wherein one or more pieces of non-woven fabric of the same or similar shape are laminated and joined substantially at one point.

13. A three-dimensional non-woven fabric according to claim 11, wherein the three-dimensional non-woven fabric is substantially of a form of a spherical structure in which non-woven fabric pieces are joined at a dot-like junction portion at the center of the sphere.

14. A three-dimensional non-woven fabric according to claim 1, wherein the non-woven fabric comprises at least one fiber selected from the group consisting of a polyethylene/polypropylene composite fiber, or a polyethylene terephthalate/polybutylene terephthalate core-sheath composite fiber, and a fiber manufactured from at least one compound selected from the group consisting of polyolefin, polyamide, polyester, polyvinyl chloride, and polyvinylidene chloride.

15. A carrier comprising the three-dimensional non-woven fabric of claim 1.

16. A carrier according to claim 15, further comprising microorganisms.

17. A waste water treatment device comprising the carrier according to claim 16.

18. A three-dimensional non-woven fabric according to claim 1, wherein said slits are formed according to the following relationship:

$$2T \geqq 45/360 \times \pi W$$

wherein, T is the thickness of said one or more pieces of non-woven fabric and W is the slit width, the slit width being the distance from one cutting line through said at least one junction portion to a second cutting line.

19. A three-dimensional non-woven fabric according to claim 1, wherein said slits are formed in said fabric prior to forming said at least one junction portion.

20. A three-dimensional non-woven fabric according to claim 1, wherein said at least one junction portion is linear or dot-like.

21. A three-dimensional non-woven fabric according to claim 1, wherein said three-dimensional non-woven fabric has a symmetrical cross-sectional shape with a linear junction portion as an axis.

22. A three-dimensional non-woven fabric according to claim 1, wherein said non-woven fabric comprises heat-melting fiber.

23. A three-dimensional non-woven fabric comprising one or more pieces of non-woven fabric joined at at least one junction portion located at a predetermined distance within said three-dimensional non-woven fabric, at least one of said pieces of non-woven fabric being connected to only one of said at least one junction portion.

24. A ring-like three-dimensional non-woven fabric comprising one or more pieces of non-woven fabric in a radial cross-sectional shape and a ring-like linear junction portion in an internal portion thereof.

25. A method of producing a three-dimensional non-woven fabric comprising:

joining one or more pieces of a non-woven fabric to form one or more junction portions in said fabric; and cutting said fabric to form slits at positions other than at said one or more junction portions.

26. A three-dimensional non-woven fabric comprising one or more pieces of non-woven fabric joined to at least one junction portion located at a predetermined distance within said three-dimensional non-woven fabric made by the process of claim 25.

27. A method of producing a three-dimensional non-woven fabric according to claim 25, wherein at least one of said one or more junction portions is substantially linear.

28. A method of producing a three-dimensional non-woven fabric according to claim 25, wherein at least one of said one or more junction portions is substantially a dot.

29. A method of producing a three-dimensional non-woven fabric according to claim 25, wherein the junction portion is formed by heat sealing, ultrasonic sealing, high-frequency sealing, by means of an adhesive agent or a yarn.

30. A method of producing a three-dimensional non-woven fabric according to claim 25, wherein said cutting step comprises cutting said fabric along a straight line, a curved line or a circle.

31. A method of producing a three-dimensional non-woven fabric according to claim 25, wherein the junction portions are dot-like junction portions, and the non-woven fabric is cut into any shape so as to include the dot-like junction portion.

32. A method of producing a three-dimensional non-woven fabric comprising joining one or more pieces of a non-woven fabric having a circular shape by joining said fabric at a dot-like junction portion at a center of the circular fabric.

33. A method according to claim 25, wherein said slits are formed according to the following relationship:

$$2T \geqq 45/360 \times \pi W$$

wherein, T is the thickness of said one or more pieces of non-woven fabric and W is the slit width, the slit width being the distance from one cutting line through said at least one junction portion to a second cutting line.

34. A method according to claim 25, wherein said non-woven fabric comprises heat-melting fiber.

35. A method of producing a three-dimensional non-woven fabric, comprising:

cutting one or more pieces of a non-woven fabric, and joining said one or more pieces of said non-woven fabric at predetermined distances to form at least one junction portion at a predetermined distance within said non-woven fabric, at least one of said pieces of non-woven fabric being connected to only one of said at least one junction.

* * * * *